United States Patent [19]

LoRusso et al.

[11] Patent Number: 4,748,947

[45] Date of Patent: Jun. 7, 1988

[54] IGNITION SYSTEM AND METHOD FOR MULTI-FUEL COMBUSTION ENGINES

[75] Inventors: Julian A. LoRusso, Woodhaven; Harry A. Cikanek, Northville; Richard W. Anderson, Ann Arbor, all of Mich.

[73] Assignee: Ford Motor Company, Dearborn, Mich.

[21] Appl. No.: 64,719

[22] Filed: Jun. 22, 1987

[51] Int. Cl.[4] ..... F02D 19/00; H01T 13/39

[52] U.S. Cl. ..... 123/145 A; 123/169 E; 313/142

[58] Field of Search ..... 123/143 R, 143 A, 143 B, 123/145 R, 145 A, 169 E; 313/141, 143, 142

[56] References Cited

U.S. PATENT DOCUMENTS

| | | | |
|---|---|---|---|
| 3,558,959 | 1/1971 | Ziemendorf . | |
| 3,883,762 | 5/1975 | Harris et al. . | |
| 4,019,473 | 4/1977 | Kamiya . | |
| 4,092,558 | 5/1978 | Yamada . | |
| 4,092,967 | 6/1978 | Haslett . | |
| 4,123,997 | 11/1978 | Oswald et al. . | |
| 4,205,650 | 6/1980 | Szwarcbier | 123/146.5 A |
| 4,342,300 | 8/1982 | Matthes . | |
| 4,398,526 | 8/1983 | Hamai et al. | 123/143 B X |
| 4,439,707 | 3/1984 | Hattori et al. . | |
| 4,476,412 | 10/1984 | Nishida et al. . | |
| 4,480,613 | 11/1984 | Siewert . | |
| 4,487,177 | 12/1984 | Ishikawa | 123/143 B X |
| 4,548,172 | 10/1985 | Bailey . | |
| 4,590,913 | 5/1986 | Faupel et al. . | |

OTHER PUBLICATIONS

SAE Paper 831744, "Development of Detroit Diesel Allison 6V-92TA Methanol Fueled Coach Engine", Toepel et al, 1983.

*Primary Examiner*—Tony M. Argenbright

*Attorney, Agent, or Firm*—Allan J. Lippa; Peter Abolins

[57] ABSTRACT

An ignition system providing both spark ignition and a hot surface for surface ignition of a stratified fuel charge. The ignition system includes a novel hot surface spark plug designed to maximize heat retention in the center electrode and surrounding insulator for enabling surface ignition over a portion of the operating cycle of the engine. Ignition power is applied only when the center electrode temperature is below a threshold temperature. When the center electrode temperature is above a threshold temperature, ignition power is applied in inverse relation to the center electrode temperature.

9 Claims, 3 Drawing Sheets

IGNITION SYSTEM AND METHOD FOR MULTI-FUEL COMBUSTION ENGINES

BACKGROUND OF THE INVENTION

The invention relates generally to an ignition system for use in combustion engines having multiple fuel capabilities.

Direct fuel injected engines combusting low cetane/-high octane fuels typically utilize high compression ratios and unthrottled conditions to achieve efficient operation. Late fuel injection during the combustion cycle is also used to avoid knocking at the high compression ratios. A problem with the late injection engines, however, is that the resulting stratified charge and lean air mixtures result in incomplete combustion and high emission levels.

An approach to provide satisfactory combustion of the stratified charge is to ignite the charge with a conventional spark plug operating with high ignition power. A disadvantage of this approach is that the high ignition power drastically reduces the spark plug life.

Another approach is to ignite a small air/fuel charge in a prechamber which requires low levels of ignition power and then to direct the ignited charge into the combustion chamber. Examples of this approach are disclosed in U.S. Pat. Nos. 4,019,473 and 4,342,300.

Still another approach is to position a grid of catalytic material within the combustion chamber such as, for example, disclosed in U.S. Pat. Nos. 4,092,967 and 4,480,613. The complexity of such a system, however, is undesirable.

SUMMARY OF THE INVENTION

It is an object of the invention to provide an ignition system which provides both spark ignition and surface ignition.

In a particular embodiment of the invention, this and other objects are achieved by providing an ignition system with a novel hot surface spark plug which retains sufficient heat of combustion to ignite the fuel charge by surface ignition, without the application of electric power, over a portion of the engine operating cycle. preferably, when spark ignition is required, electric power is applied in inverse proportion to the heat retained by the spark plug. More specifically, the ignition system includes: electrode means, including a center electrode, positioned in the combustion chamber for providing a spark in response to the application of electric power and for retaining a portion of the heat of combustion; indicator means for providing an indication of the temperature of the center electrode by sensing an engine parameter to which the center electrode temperature is related; and ignition means responsive to the indicator means for applying pulsed electric power to the center electrode, the electric power being inversely related to the center electrode temperature, the electric power being removed when the center electrode reaches sufficient temperature for surface ignition.

DESCRIPTION OF THE PREFERRED EMBODIMENT

Figure 1:
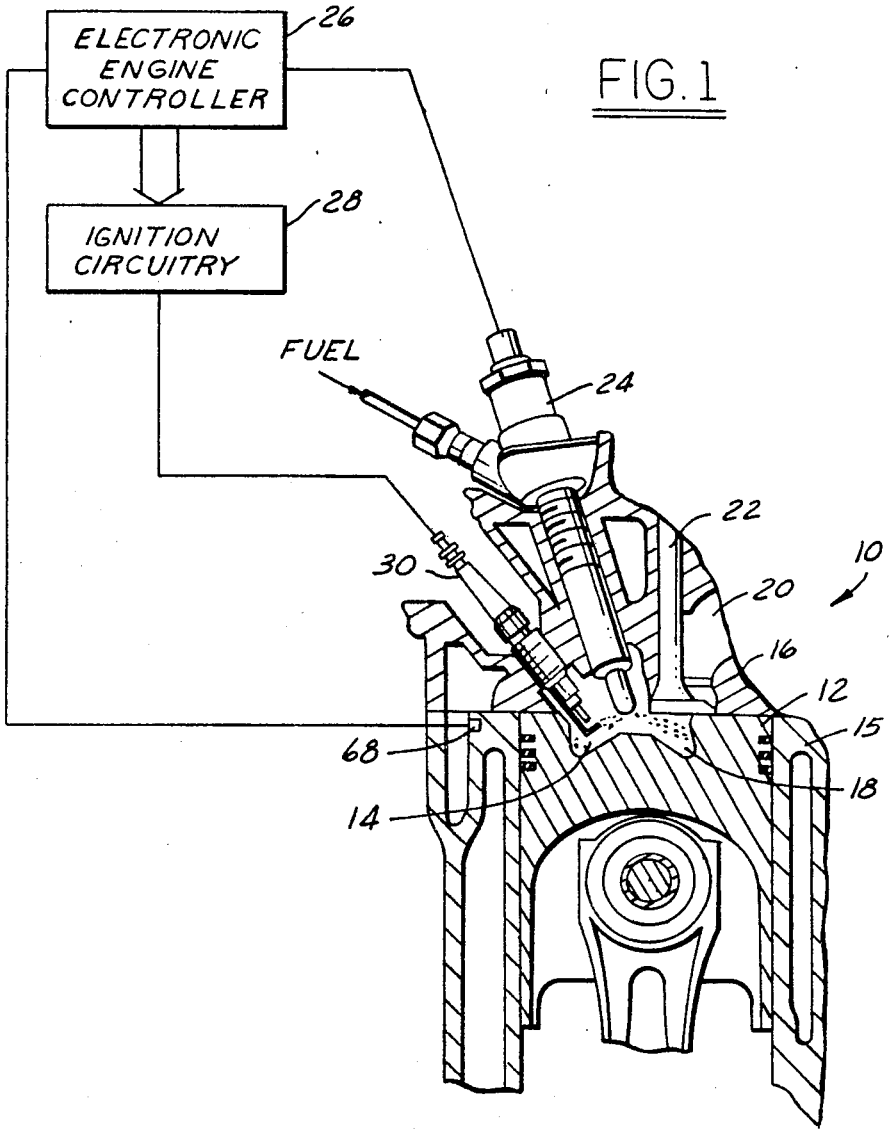
FIG. 1 is a cross-sectional view of an engine in which the invention is used to advantage.

Referring to FIG. 1, a portion of an internal combustion engine is shown for illustrating the use of the invention herein. More specifically, engine 10 is shown including a piston 12, preferably including a bowl 14, slidably positioned within engine block 15 and cylinder head 16. In a conventional manner, piston 12 and cylinder head 16 define a combustion chamber 18 of varying volume and pressure. Piston 12 is here illustrated at top dead-center position (TDC) whereby bowl 14 and combustion chamber 18 are of approximately equal volume. The compression ratio of engine 10 is between 12:1 and 22:1, preferably 18:1, to achieve acceptable power from low cetane fuel and also to achieve surface ignition under certain operating conditions as described hereinafter.

A conventional air inlet 20 and inlet valve 22 are here shown for enabling the induction of unthrottled air. Other conventional components, well known to those skilled in the art, are not shown herein since they are not necessary for an understanding of the invention.

Figure 2:
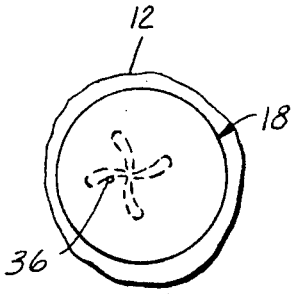
FIG. 2 is a schematic representation of the fuel spray pattern in the combustion chamber of the engine illustrated in FIG. 1.

Continuing with FIG. 1, and also referring to FIG. 2, fuel injector 24 is shown connected to head 16 and coupled to combustion chamber 18. Fuel injector 24 preferably sprays a pattern of fuel having four lobes (FIG. 2) at 3,000–20,000 psi differential pressure directly into combustion chamber 18. The high pressure injection is required to meter a sufficiently large amount of low cetane/high octane fuel, such as methanol, late in the compression stroke to provide adequate engine power. As described in greater detail hereinafter, engine controller 26 electrically actuates injector 24 late in the compression cycle, preferably 5–15° crank angle position before TDC (FIG. 5), to prevent knocking at the high compression ratio and lean air/fuel mixtures characteristic of engine 10. However, as is well known in the art, the resulting stratified fuel charge of a fuel having a high heat of vaporization requires high levels of ignition power to prevent incomplete combustion. Typically, the ignition power required is from 2–5 times that of a conventional gasoline engine.

Figure 3A:
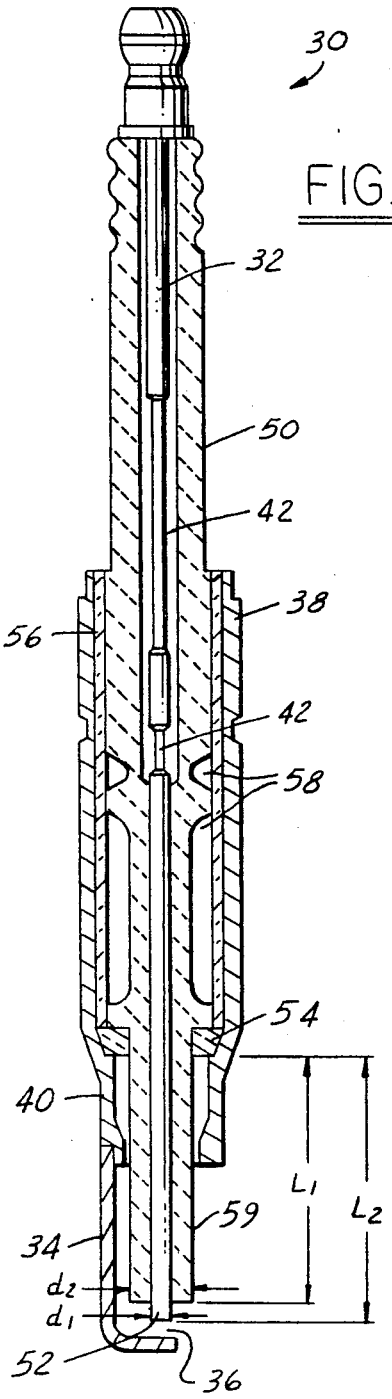
FIG. 3A is a cross-sectional view of a hot surface spark plug which utilizes the invention to advantage.

With reference to FIG. 1, and also referring to FIG. 3A, electrode apparatus or hot surface spark plug 30 is shown connected to head 16 such that center electrode 32, outer electrode 34, and spark gap 36 formed therebetween extend sufficiently far into combustion chamber 18 to impinge upon the outer periphery of the fuel spray (FIG. 2).

Hot surface spark plug 30 is specifically designed to maximize the retention of combustion heat in center electrode 32. In this manner, center electrode 32 and the surrounding insulator provides a hot surface, preferably above 800° C., to ignite the fuel spray without the application of electric power during most of the operating cycle of engine 10. Spark ignition is therefore only necessary during starting and low engine load conditions. In contrast, conventional spark plugs are deliberately designed to reduce the retention of combustion heat for preventing auto ignition.

Continuing with FIG. 3A, spark plug 30 is shown having an electrically conductive casing 38 with a tapered portion 40 adapted for insertion into cylinder head 16. Center electrode 32, constructed of an electrical conductor having a thermal conductivity of less than 27 w/(m°K.), such as Inconnel 700 with a thermal conductivity of approximately 9.5 w/m°K., is shown coaxially positioned within casing 38. Several constrictions 42 are shown formed within center electrode 32 to restrict the conduction of heat therethrough. Dielectric insulator 50, constructed of an electrical insulator having a dielectric strength of greater than 18 Kv/mm, such as aluminum oxide ($Al_2O_3$), is shown encasing a portion of outer electrode 32 to define an exposed end 52 of center electrode 32. The protrusion of dielectric insulator 50 beyond outer casing 38 defines a protruding insulator end 59. Heat retention in insulator end 59 is preferably maximized to further aid surface combustion. Thermal insulating ring 52, preferably constructed from fused silicon oxide, is shown for positioning or mechanically coupling dielectric insulator 50 to casing 38. Outer electrode 34 is here shown as a single electrode having one end connected to casing 38 and the other end facing the outer surface of electrode end 52 to form a spark gap 36 therebetween. Although a single outer electrode and spark gap are shown, those skilled in the art will recognize that spark plug 30 may be constructed to include multiple outer electrodes, and it may also be constructed as a surface gap plug wherein the outer electrodes face dielectric insulator 50.

Thermal insulator 56, constructed of a material with a thermal conductivity of less than 27 w/(m°K.), such as partially stabilized zirconia oxide ($ZrO_2$) having a thermal conductivity of approximately 2.5 w/(m°K.), is shown positioned between casing 38 and dielectric insulator 50. Several air pockets 58 are shown formed between dielectric insulator 50 and thermal insulator 56 to further thermally insulate center electrode 32 from casing 38.

As previously described herein, spark plug 30 is constructed to maximize the retention of combustion heat rather than reduce heat retention as in the case of a conventional plug. Heat retention has been increased by the proper selection and placement of materials such as insulators and conductors described hereinabove. Further increases in heat retention with respect to conventional plugs are accomplished by: decreasing diameter $d_1$ of center electrode 32, here shown as 1.5 mm; increasing the diameter $d_2$ of dielectric insulator 50, here shown as 5.5 mm; and increasing length $L_1$ of dielectric insulator 50 from the mechanical coupling with casing 38, here shown as 22 mm. More specifically, heat retention is further increased by providing a $d_1$ to $d_2$ ratio of less than 0.5 and a $L_1$ to $L_2$ ratio of greater than 0.4.

Center electrode end 52 may preferably be capped (not shown) with a catalytic material, such as platinum, to further enhance surface ignition and thereby reduce the ignition power required.

Figure 3B:
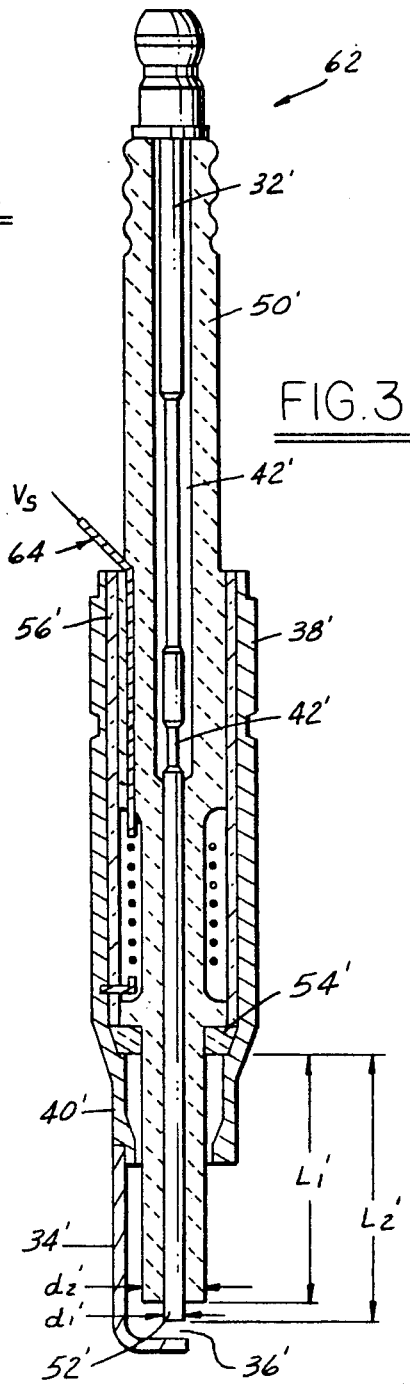
FIG. 3B is a cross-sectional view of an alternate hot surface spark plug which utilizes the invention to advantage.

An alternative hot surface spark plug is illustrated in FIG. 3B wherein like parts bear the corresponding reference numerals and reference letters to those in FIG. 3A. Sparkplug 62 is shown having an electric heater 64 or electrically resistive coil positioned between dielectric insulator 50' and thermal insulator 56' for heating center electrode 32' and dielectric insulator 50'. Electric heater 64 is connected at one end to the automobile voltage supply ($V_s$) and at the other end to the automobile ground via casing 38'.

Figure 4:
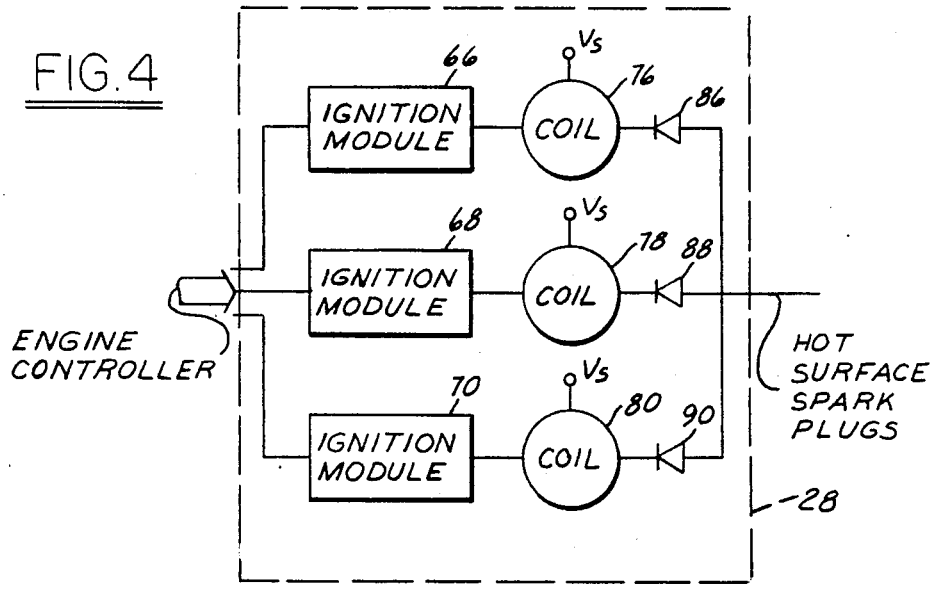
FIG. 4 is an electrical schematic of the ignition circuitry shown in block diagram form in FIG. 1.

Referring back to FIG. 1, and also referring to FIG. 4, ignition circuitry 28 is shown coupled between engine controller 26 and spark plug 30. When full ignition power is required, engine controller 26 provides a signal to ignition modules 66, 68 and 70 to interrupt primary current in respective coils 76, 78 and 80, thereby generating sufficient secondary spark voltage which is applied through respective power diodes 86, 88 and 90 for plasma breakdown of the air in spark gap 36. The parallel circuitry here shown generates a voltage of 5,000 v to 40,000 v and current of 50 to 100 ma. Preferably, engine controller 26 sequentially initiates ignition modules 66, 68 and 70 to lengthen the spark duration when full power is desired.

Engine controller 26 actuates only those ignition modules necessary for the required level of ignition power as determined by engine operating conditions. For example, engine controller 26 actuates only ignition modules 66 and 68 for two-thirds ignition power, or ignition module 66 for one-third ignition power, or none of the ignition modules when spark ignition power is not required.

The ignition power required is inversely proportional to the temperature of combustion chamber 18 and, more specifically, to the temperature of center electrode 32. An indication of the temperature is provided to engine controller 26 by cylinder head temperature sensor 68 (FIG. 1). The invention may, however, be used to advantage by monitoring other engine parameters indicative of the temperature of center electrode 32 such as engine speed, engine load, oil or coolant temperature, or the actual temperature of center electrode 32.

Figure 5:
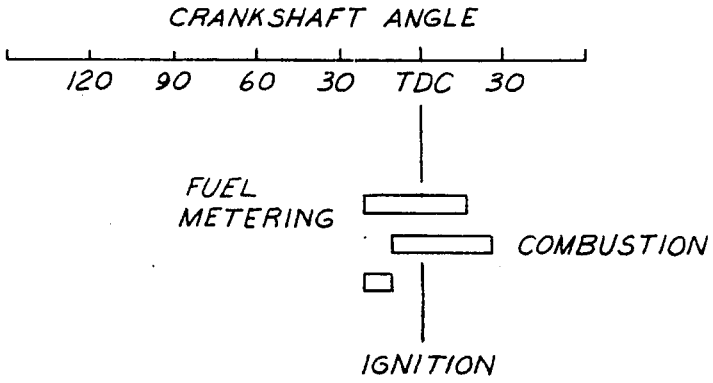
FIG. 5 is a diagram of the timing for various engine operations.

The operation of the ignition system, including hot surface spark plug 30, is now described with particular reference to FIG. 5. Fuel is injected directly into combustion chamber 18 late in the compression cycle approximately 20° before TDC. In this manner, engine knocking is avoided which might otherwise occur at either higher combustion chamber temperatures or when higher cetane fuels are used. Concurrently with the fuel injection, spark ignition is initiated when the temperature of the center electrode 32 is not sufficiently high to provide surface ignition. The ignition power supplied is inversely proportional to the temperature of center electrode 32. At higher temperatures, less ignition power is required to ignite the high latent heat of vaporization fuel, electrode life is thereby prolonged. When engine 10 is operating at sufficiently high temperatures, the heat retained by center electrode 32 and protruding insulator end 59 is sufficient to provide surface ignition. Consequently, ignition power is then shut off entirely by engine controller 26 to substantially prolong the life of the spark plug electrode.

This concludes the description of the preferred embodiment. The reading of it by those skilled in the art will bring to mind many modifications and alterations without departing from the spirit and scope of the invention. Accordingly, it is intended that the scope of the invention be limited only by the following claims.

We claim:

1. A method for combusting fuel in the combustion chamber of a multi-fuel internal combustion engine by both spark ignition and hot surface ignition, comprising the steps of:

retaining combustion heat in an electrode apparatus positioned in said combustion chamber for providing surface ignition of the fuel when said electrode apparatus has reached a sufficient temperature, said electrode apparatus having at least a pair of electrodes;

providing an indication of the surface temperature of said electrode apparatus within said combustion chamber by sensing a parameter of said internal combustion engine to which said surface temperature is related; and applying pulsed electric power to said pair of electrodes positioned in said combustion chamber for providing a spark therebetween, said electric power being inversely related to said indication of said surface temperature, said electric power being shut off when said indication of said surface temperature is above a threshold value.

2. The method recited in claim 1 wherein said sensing step includes sensing the load of said engine.

3. The method recited in claim 1 wherein said sensing step includes sensing the temperature of said internal combustion engine.

4. The method recited in claim 1 wherein said detecting step includes detecting the speed of said internal combustion engine.

5. The method recited in claim 1 wherein said detecting step includes detecting the load on said internal combustion engine.

6. An apparatus for combusting fuel in the combustion chamber of an internal combustion engine, comprising:

electrode means positioned in said combustion chamber for providing a spark within said combustion chamber in response to the applioation of electric power and for retaining a portion of the heat of combustion, said electrode means comprising an outer electrode and a center electrode separated by both a layer of dielectric and a layer of thermal insulation;

indicator means for providing an indication of the temperature of said center electrode; and ignition means responsive to said indicator means for applying said electric power to said electrode means, said ignition means applying said electric power in an inverse relation to said indication of said center electrode temperature, said ignition means shutting off said electric power when said center electrode temperature is above a threshold value.

7. The apparatus recited in claim 6 further comprising:

an electric heater positioned in thermal relationship with said center electrode; and means for supplying a voltage to said electric heater.

8. An apparatus for combusting fuel in the combustion chamber of an internal combustion engine, comprising:

electrode means positioned in said combustion chamber for providing a spark within said combustion chamber in response to the application of electric power and for retaining a portion of the heat of combustion, said electrode means comprising an outer electrode and a center electrode separated by at least one insulating layers having a combined dielectric strength greater than 18 Kv/mm and a combined thermal conductivity less than 27 watts/(m°K.);

indicator means for providing an indication of the temperature of said center electrode; and ignition means responsive to said indicator means for applying, said electric power to said electrode means, said ignition means applying said electric power in an inverse relation to said indication of said center electrode temperature, said ignition means shutting off said electric power when said center electrode temperature is above a threshold value.

9. A spark plug adapted to retain heat from the combustion chamber of an internal combustion engine, comprising:

an elongated conductive casing having a coupling end for coupling with said combustion chamber;

a cylindrical center electrode coaxially positioned within said casing having a diameter $D_1$, said center electrode extending beyond said casing into said combustion chamber;

a substantially cylindrical dielectric insulator having a diameter $D_2$ surrounding a portion of said center electrode to define an exposed center electrode end, said dielectric insulator extending from a mechanical coupling with said conductive casing to said exposed center electrode end to define a length $L_1$;

said cylindrical center electrode extending from said mechanical coupling beyond length $L_1$ to define a length $L_2$;

said length $L_1$ being related to said length $L_2$ by a ratio of at least 0.75;

said diameter $D_1$ being related to said diameter $D_2$ by a ratio of less than 0.25; and at least one center-electrode having an end connected to said casing and another end spatially separated from said exposed center electrode end thereby defining a spark gap.

* * * * *